US005096124A

United States Patent [19]

Young

[11] Patent Number: 5,096,124

[45] Date of Patent: Mar. 17, 1992

[54] BURNER APPARATUS

[75] Inventor: Timothy M. Young, Coppell, Tex.

[73] Assignee: Halliburton Company, Duncan, Okla.

[21] Appl. No.: 593,157

[22] Filed: Oct. 5, 1990

[51] Int. Cl.[5] ..... F23D 11/00; B05B 7/00

[52] U.S. Cl. ..... 239/423; 239/424; 239/424.5; 431/202

[58] Field of Search ..... 239/419, 419.3, 422–425, 239/427.5; 431/202

[56] References Cited

U.S. PATENT DOCUMENTS

| | | | |
|---|---|---|---|
| 3,330,485 | 7/1967 | Misner | 239/419 |
| 3,578,246 | 5/1971 | Davis, Sr. | 239/424.5 |
| 3,797,992 | 3/1974 | Straitz, III | 431/285 |
| 3,807,932 | 4/1974 | Dewald | 431/202 |
| 3,844,831 | 7/1975 | Glotin et al. | 431/4 |
| 3,980,416 | 9/1976 | Goncalves et al. | 431/202 |
| 4,092,095 | 5/1978 | Straitz, III | 431/202 |
| 4,348,171 | 9/1982 | Issenmann | 431/202 |
| 4,419,071 | 12/1983 | Schwartz | 239/419.3 |
| 4,452,583 | 6/1984 | Brooks | 239/424.5 |

FOREIGN PATENT DOCUMENTS 2112920 7/1983 United Kingdom .

OTHER PUBLICATIONS

Article entitled "Smokeless burner aids offshore well testing", published in Oct. 1972, issue of World Oil.

*Primary Examiner*—Andres Kashnikow
*Assistant Examiner*—Lesley D. Morris
*Attorney, Agent, or Firm*—C. Dean Dominque; Neal R. Kennedy

[57] ABSTRACT

A burner apparatus for burning hydrocarbons. The apparatus comprises a body defining a plurality of nozzle ports therein, each port facing in a different direction, a discharge nozzle disposed in each nozzle port, and a water ring assembly disposed around the body. Each nozzle is held in place by a retainer such that a first gap is defined therebetween, and a retainer nut is attached to the body adjacent to the retainer such that a second gap is defined between the retainer and the nut. This second gap acts as an air discharge orifice and is in communication with an air passage defined in the body. The water ring assembly comprises an outer ring and an inner ring which combine to define an annular water chamber therebetween. The water chamber is in communication with a plurality of notches in the outer ring which act as water discharge nozzles for directing a water stream toward the burning petroleum and air stream discharged from the apparatus. The notches are fully exposed when the water ring assembly is disassembled, thereby making cleaning of the notches a simple matter. The body is pivotally connected to petroleum line by a swivel fitting. The apparatus may be locked in any pivoted position with respect to the petroleum line.

16 Claims, 2 Drawing Sheets

BURNER APPARATUS

BACKGROUND OF THE INVENTION

1. Field Of The Invention

This invention relates to burners for burning petroleum products during well testing, and more particularly, to a burner apparatus having a body which may have multiple burner nozzles therein and an easily disassembled and cleaned water spray ring assembly.

2. Description Of The Prior Art

When well tests are performed, disposal of the petroleum or other hydrocarbon products therefrom is generally carried out by burning. One problem with burning the hydrocarbon products is in insuring that the burner can adequately handle the amount of hydrocarbons to be burned. This requires that the nozzles in the burner atomize the petroleum products as much as possible and that an adequate air supply be provided to insure as Complete combustion as possible. There is also a necessity to protect the rest of the well installation from the great amount of heat generated by the burner and to reduce the black smoke produced.

U.S. Pat. No. 3,894,831 to Glotin et al. discloses a burner having multiple individual burner assemblies or nozzles which are pointed in slightly divergent directions. A ring-like water injection system is disposed around each burner nozzle, and the water injection system has a plurality of individual nozzles which direct a spray of water toward the flame. The water acts to reduce the radiated heat from the burner and also to reduce the amount of black smoke generated in the combustion process. The apparatus may be swiveled so that the flame is directed downwind from the well. Other burners which have multiple nozzles, are rotatable and have water sprays include those disclosed in British Patent No. 2,112,920 to Dewald; U.S. Pat. No. 4,348,171 to Issenmann; and U.S. Pat. No. 3,797,992 to Straitz, III. U.S. Pat. No. 3,980,416 to Goncalves et al. discloses a single nozzle burner which is rotatable and has ring-shaped water sprayers.

In the prior art burners with multiple nozzles, the nozzles are separate, individual assemblies and therefore require relatively complex piping systems. The relatively large number of connections increases the possibility of leaks of petroleum products, air and/or water, any of which could cause problems. The present invention solves this problem by providing a burner with a body which may have a plurality of nozzle ports therein. A single petroleum connection and a minimum of air connections to the body may be used.

An additional problem with prior art burners having water spray systems is that these utilize individual water nozzles. These water nozzles must be cleaned individually and are difficult to clean in the first place. The present invention solves this problem by providing a burner with a water ring which comprises an inner ring and an outer ring, wherein one of the rings has a plurality of notches therein. The notches form the water spray openings, and the rings are easily separated so that the notches are exposed for simple cleaning.

SUMMARY OF THE INVENTION

The burner apparatus of the present invention is designed for the disposal of petroleum or other hydrocarbon products, such as generated during well testing. The burner apparatus comprises housing means for connecting to a petroleum source and an air source. The housing means defines an air passage therein in communication with the air source and one or a plurality of nozzle ports therein in communication with the petroleum source. The burner apparatus further comprises a petroleum discharge nozzle disposed in each nozzle port. When a plurality of nozzle ports are used, each of the nozzle ports preferably faces in a different direction.

A retaining means is used for retaining the nozzles in the nozzle ports. The retaining means preferably defines an air discharge nozzle therein which is in communication with the air passage in the housing means. The retaining means may be characterized by a retainer positioned adjacent to the nozzle means such that a first annular gap is defined therebetween, and a retainer nut attached to the housing means adjacent to the retainer such that a second annular gap is defined between the retainer and the nut. The second annular gap is in communication with the air passage. The second gap forms the air discharge nozzle, and is preferably substantially conical in configuration. A sealing means may be provided for sealingly separating the first and second annular gaps.

The burner apparatus preferably further comprises pivotation or swivel means for pivotally mounting the housing means on a portion of a petroleum line from the petroleum source. In one preferred embodiment, the pivotation means is characterized by a ball bearing-type swivel connection between the housing means and the petroleum line. A locking means may be provided for locking the housing means in any pivoted position with respect to the petroleum line.

The burner apparatus further comprises water spraying means disposed around the housing means for connecting to a water source and spraying water toward a petroleum and air stream mixture discharged from the petroleum and air nozzles. The water spraying means may be characterized by a water ring assembly comprising an outer ring and an inner ring positioned at least partially within the outer ring. The inner and outer rings define a water chamber therein, and at least one of the inner and outer rings defines a plurality of notches which at least partially form water discharge nozzles whereby water may be sprayed toward the petroleum stream. The notches are preferably substantially arcuate, and the water discharge nozzles are at least partially bounded by a portion of the other of the inner and outer rings. In the illustrated embodiment, the notches are defined in an upper portion of the outer ring and are adjacent to an outer surface of the inner ring. The notches may be spaced in a substantially arcuate pattern on the water ring assembly. For example, but not by way of limitation, the notches may be spaced in a semi-circular pattern such that a substantially semi-circular water spray is directed toward the petroleum and air stream mixture.

A mounting means is provided for mounting the water spraying means around the housing means. This mounting means comprises a bracket attached to the water ring assembly, a pin attached to the housing means and extending through the bracket, and retaining means for retaining the pin adjacent to the bracket. In the illustrated embodiment, the bracket has a yoke-like configuration with a pin extending therethrough, and the retaining means is characterized by a cotter pin. A plurality of such brackets and pins may be used so that the water ring assembly is properly positioned. However, the pins are free to move within corresponding brackets so that compensation is provided for expansion and contraction of the components resulting from temperature variations.

An important object of the invention is to provide a burner apparatus with a water spray system that is easily cleaned.

An additional object of the invention is to provide a burner apparatus having a body with a plurality of nozzles therein.

A further object of the invention is to provide a burner apparatus with a body defining an air passage and a plurality of petroleum nozzle ports therein, each of the nozzle ports facing in a slightly different direction.

An additional object of the invention is to provide a burner apparatus with a nozzle assembly which is retained by an insert such that a gap is defined between the insert and nozzle assembly which acts as a leak passage for petroleum and/or air.

Another object of the invention is to provide a burner apparatus with a water spray system mounted on a petroleum and air housing means in such a way as to compensate for expansion and contraction of the components.

Still another object of the invention is to provide a rotatable oil burner with a minimum number of petroleum, air and water connections to reduce the possibility of leakage.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
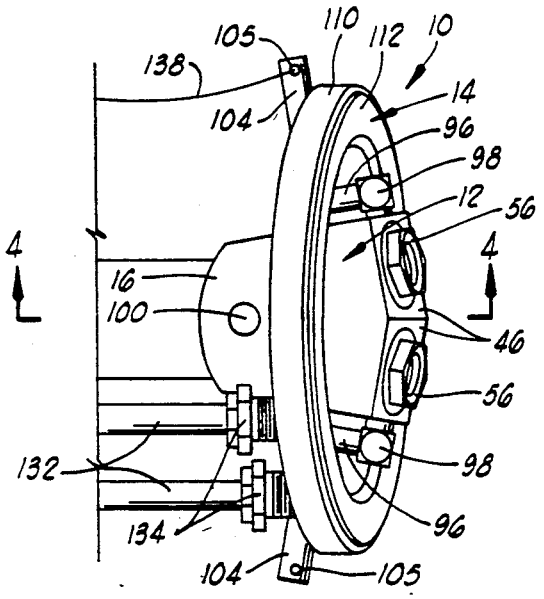
FIG. 1 is a plan view of the burner apparatus of the present invention.
Figure 3A:
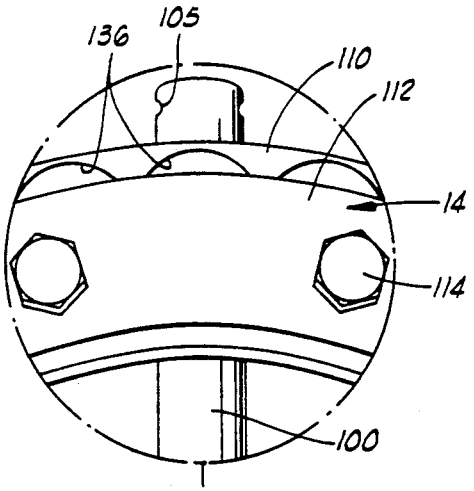
FIG. 3A is an enlargement of a portion of FIG. 3.
Figure 2:
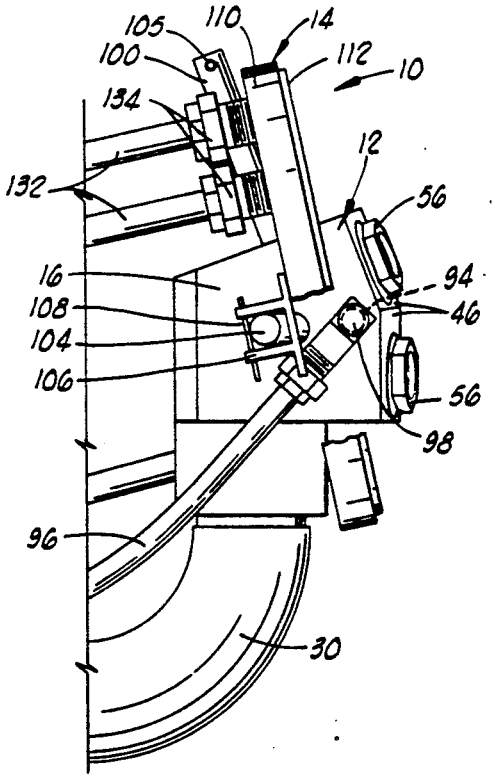
FIG. 2 is a side elevation view of the burner apparatus with a portion of a water spray ring assembly cut away.
Figure 3:
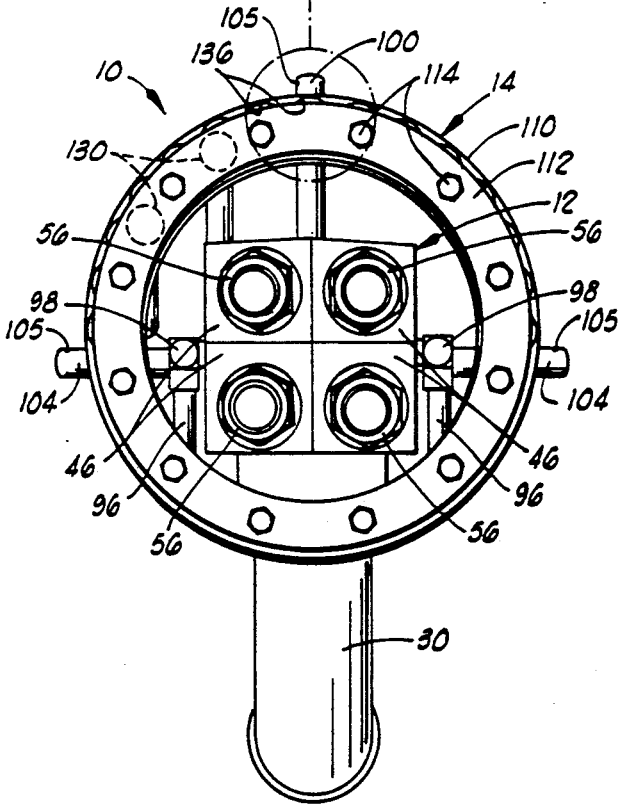
FIG. 3 presents a discharge end view of the burner.

Referring now to the drawings, and more particularly to FIGS. 1-3, the oil burner apparatus of the present invention is shown and generally designated by the numeral 10. Apparatus 10 generally comprises a housing means 12 for connecting to a petroleum supply source and an air supply source and for directing the petroleum and air outwardly for combustion of the petroleum. Apparatus 10 further generally comprises a water spraying means 14 for connecting to a water supply source and spraying water toward the burning petroleum to reduce radiative heat and black smoke.

Figure 4:
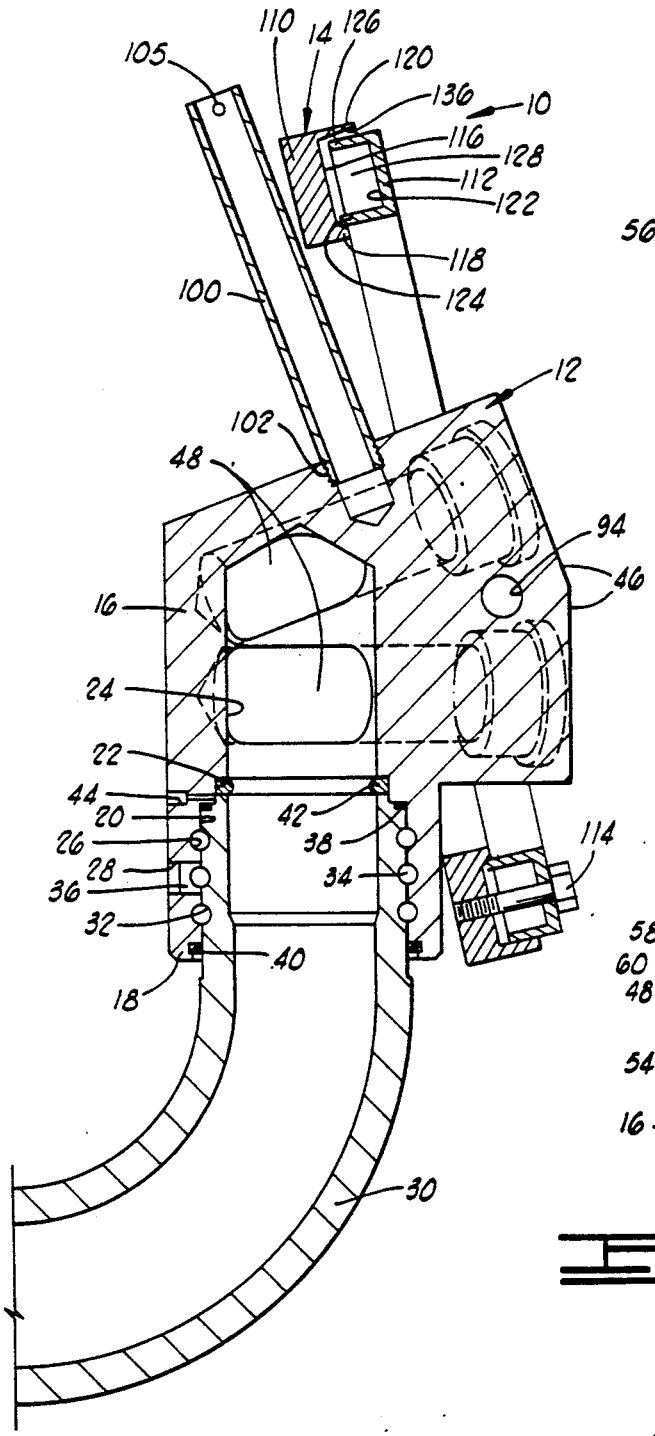
FIG. 4 is a vertical cross section of the burner taken along lines 4—4 in FIG. 1.
Figure 5:
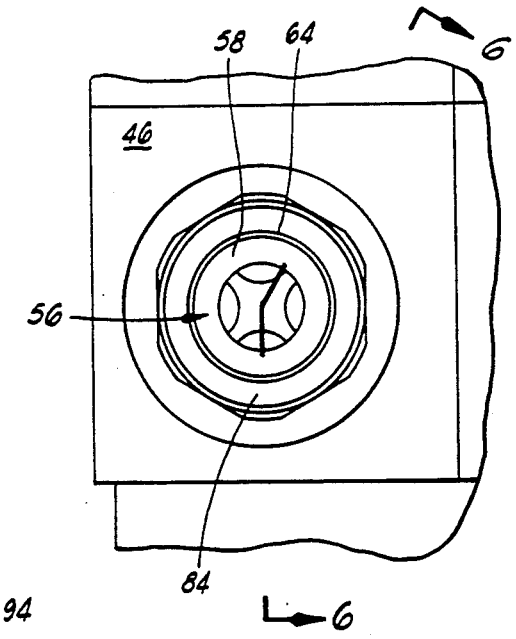
FIG. 5 is a detailed discharge end elevation of one nozzle in the burner.

Referring now also to FIG. 4, the details of housing means 12 will be discussed. Housing means 12 comprises a body 16 with a generally cylindrical lower portion 18. Lower portion 18 defines a first bore 20 therein. Body 16 also defines a second bore 22 and a third bore 24 which are in communication with first bore 20.

A plurality of rounded grooves 26 are formed in first bore 20, and a transverse hole 28 is in communication with each groove 26. The upper end of an elbow connector 30 extends into first bore 20. Elbow connector 30 defines a plurality of rounded grooves 32 thereon, each groove 32 being aligned with a corresponding groove 26 in body 16 such that an annular channel is defined between elbow connector 30 and lower portion 18 of body 16. Disposed in each of these channels are a plurality of steel balls 34. Balls 34 are held in their corresponding channels by a plug 36 disposed in each transverse hole 28 and act as ball bearings. Grease may be provided for lubrication. Thus, a pivotation or swivel means is provided for pivotally connecting body 16 to elbow connector 30. This kind of ball bearing swivel connection is generally known, but not in the art of petroleum burners.

The other end of elbow connector 30 is connected to the petroleum source and is mounted on a well boom in a manner known in the art. Thus, elbow connector 30 is a portion of the petroleum line from the petroleum source.

A sealing means, such as O-ring 38, provides sealing engagement between body 16 and elbow connector 30. A grease sealing means, such as grease seal 40, provides sealing engagement between body 16 and elbow connector 30 to retain lubricating grease in the pivotation means.

The sealing means between body 16 and elbow connector 30 may further comprise a seal ring 42, preferably made of a heat resistant material. A vent 44 may be provided between seal ring 42 and O-ring 38 to reduce the fluid pressure on O-ring 38.

Body 16 has a plurality of outlet faces 46 thereon. Preferably, each of outlet faces 46 faces in a slightly different direction from the others. That is, each outlet face 46 is angled slightly away from each other outlet face 46 so that they diverge. In the illustrated embodiment, body 16 has four such outlet faces 46. However, the invention is not intended to be limited to this particular configuration. Any number of outlet faces, including just one, could be used as desired.

Extending perpendicularly into body 16 from each of outlet faces 46 is a nozzle port 48. Each of nozzle ports 48 intersects third bore 24 in body 16 and thus a petroleum passage is formed in communication with the petroleum source.

Figure 6:
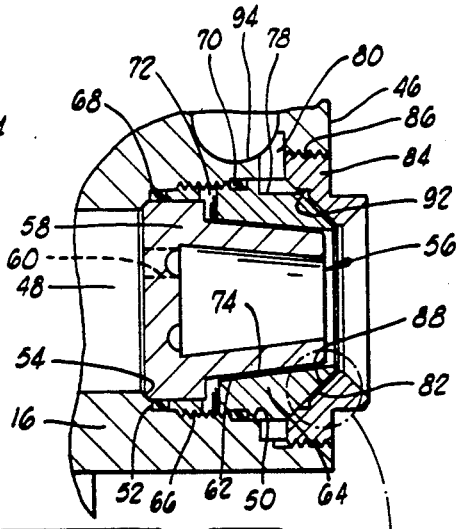
FIG. 6 is a cross section taken along lines 6—6 in FIG. 5.

Referring now to FIG. 6, at the outer end of each nozzle port 48 are a bore 50 and a somewhat smaller bore 52 having a chamfered shoulder 54 adjacent thereto.

A petroleum discharge nozzle means 56 for directing a petroleum stream from body 16 is disposed in the outer end of each nozzle port 48. Nozzle means 56 can include a nozzle of any kind known in the art. In the embodiment shown in FIG. 6, the nozzle means comprises a nozzle insert 58 positioned against chamfered shoulder 54 and having a plurality of entrance orifices 60 therein. Insert 58 has a substantially conical outer surface 62. Insert 58 may be of the type more fully described in co-pending U.S. patent application Ser. No. 07/431,050, assigned to the assignee of the present invention, and incorporated herein by reference.

Nozzle means 56 further comprises a retaining means, including in part a retainer 64 attached to body 16 at threaded connection 66. A sealing means, such as O-ring 68, provides sealing engagement between body 16, insert 58 and retainer 64 on one side of threaded connection 66. Another sealing means, such as O-ring 70, provides sealing engagement between retainer 64 and body 16 on the opposite side of threaded connection 66. At least one transverse hole 72 extends through retainer 64 between O-rings 68 and 70.

Figure 6A:
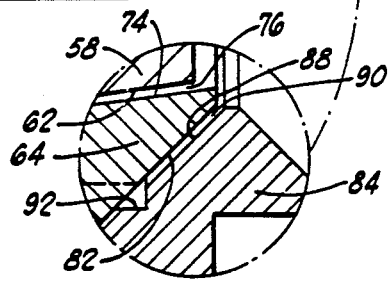
FIG. 6A is an enlargement of a portion of FIG. 6.

Referring now also to FIG. 6A, retainer 64 has a conical bore 74 therein which is spaced outwardly from conical surface 62 on insert 58 such that an annular, conical gap 76 is defined therebetween. It will be seen that gap 76 is in communication with transverse hole 72. In this way, any leakage of petroleum past O-ring 68 or air past O-ring 70 will eventually be carried through gap 76 out of nozzle means 56.

On the outside of retainer 64 are a plurality of wrenching flats 78 which are adjacent to a recess 80 in body 16. Retainer 64 also has a substantially conical outer surface 82 thereon.

The retaining means also includes a retainer nut 84 which is disposed outwardly of retainer 64 in nozzle port 48 and is attached to body 16 at threaded connection 86. Still referring to FIGS. 6 and 6A, nut 84 has a conical bore 88 which is spaced outwardly from conical surface 82 on retainer 64 such that a conical annular gap 90 is defined therebetween. Nut 84 also has a notch 92 therein. It will be seen by those skilled in the art that gap 90 is in communication with recess 80 in body 16 and that notch 92 and flats 78 on retainer 64 help provide this communication.

Referring now to FIGS. 4 and 6, body 16 defines a transversely disposed air passage 94 therethrough. As seen in FIG. 6, air passage 94 is in communication with recess 80, and thus in communication with gap 90 between nut 84 and retainer 64.

As shown in FIGS. 1-3, an air line 96 is connected to air passage 94 by a fitting 98. If necessary, a plurality of air lines 96 and fittings 98 may be used as seen in FIGS. 1 and 3. Each air line 96 is connected to the air supply source in a known manner, and it will be seen by those skilled in the art that the air supply is thus in communication with gap 90 such that a conical stream of air will be directed to impinge any petroleum stream that is discharged from insert 58.

Referring now to FIG. 4, an elongated pin 100 is attached to the top of body 16 at threaded connection 102. As seen in FIG. 3, substantially similar pins 104 are attached to each side of body 16. At the outer end of each pin 100 and 104, a hole 105 is defined therethrough.

Each of pins 104 extends through a yoke-like bracket 106, as seen in FIG. 2. Brackets 106 are attached to the back side of water spray means 14. A cotter pin 108 extends through each bracket 106 substantially transversely to pins 104 and on a side opposite the pins from water spray means 14. Another bracket could also be used for pin 100.

Preferably, but not by way of limitation, there are at least two pins 104 with corresponding brackets 106 and cotter pins 108. In this way, water spray means 14 is positioned in its desired position around housing means 12, with pin 100 providing additional support. Brackets 106 and pins 104 are sized such that pins 104 are allowed freedom of movement within the brackets, and in this way, it will be seen that this mounting means for mounting water spray means 14 allows for expansion and contraction of the components as necessary, depending upon the amount of heat present.

Referring now to FIGS. 1-4, water spray means 14 is preferably characterized by a ring-like assembly comprising an outer ring 110 and an inner ring 112 attached to one another by fastening means, such as a plurality of bolts 114. Bolts 114 are shown in FIGS. 3, 3A and 4.

Referring now to the cross-sectional details in FIG. 4, outer ring 110 defines an annular groove 116 therein bounded by a radially inner lip 118 and a radially outer lip 120. Inner ring 112 defines an annular groove 122 bounded by an inner lip 124 and an outer lip 126. Inner lip 124 of inner ring 112 is positioned adjacent to inner lip 118 of outer ring 110. Inner lip 124 of inner ring 112 is somewhat longer than outer lip 126 thereof such that outer lip 126 is spaced slightly away from groove 116 in outer ring 110. A substantially annular chamber 128 is defined between outer ring 110 and inner ring 112 by grooves 116 and 122.

Referring now to FIG. 3, at least one water inlet port 130 is defined in outer ring 110, and each water inlet port 130 is in communication with annular chamber 128 between outer ring 110 and inner ring 112. A water line 132 from the water supply source is connected to each water inlet port 130 by a water fitting 134.

Referring again to FIGS. 3, 3A and 4, outer ring 110 defines a plurality of spaced curvilinear notches 136 therein. Notches 136 are cut into outer lip 120 of outer ring 110, and as seen in FIG. 4, notches 136 are thus in communication with annular chamber 128. Each notch 136 may be said to form a water nozzle 136 bounded on the inner side by outer lip 126 of inner ring 112. In an alternate construction, the notches could be formed on the outside of inner ring 112 and bounded on the outer side thereof by outer lip 120 of outer ring 110.

OPERATION OF THE INVENTION

As previously described, elbow connector 30 of oil burner apparatus 10 is connected to the petroleum supply, such as on the boom of a well, in a manner known in the art. Similarly, air lines 96 are connected to the air supply, and water lines 132 are connected to the water supply, both the air supply and water supply also being of a kind known in the art.

In operation, petroleum is discharged from apparatus 10 through each nozzle means 56. As previously described, each nozzle means 56 is directed in a slightly different diverging direction. A conical air stream is discharged through an air nozzle formed by annular gap 90 to be mixed with a petroleum stream for proper combustion. A pilot (not shown) of a kind known in the art ignites the petroleum and air stream and is usually positioned at the lower side thereof.

Water is discharged from apparatus 10 through water nozzles 136 to form an arcuate spray directed toward the burning petroleum which reduces the heat of radiation from the flame and also acts to reduce the amount of black smoke produced by the combustion. In the embodiment shown, water nozzles 136 are spaced to form a substantially semi-circular pattern, as best seen in FIG. 3. That is, notches 136 are formed in outer ring 110 of water spray means 14 substantially only in the top half thereof. This is sufficient to keep down the heat and black smoke, but because water is not being discharged from the bottom of water spray means 14, there is no danger of the water putting out the pilot.

If water nozzles 136 become clogged, it is a simple matter to clean them. By removing bolts 114 so that outer ring 110 and inner ring 112 are separated, it will be seen that notches 136 are thus fully exposed and are easily cleaned of any deposits thereon, unlike the typical small orifice in a water discharge system.

The entire apparatus is free to pivot on elbow connector 30 by the swivel fitting previously described so that the flame can be directed substantially downwind away from the well. A locking means may be provided for locking apparatus 10 in any pivoted position as desired. In one embodiment, the locking means is characterized by one or more cables 138 attached to hole 105 at the end of pins 100 and/or 104. Such a cable 138 is shown in FIG. 1.

It will be seen, therefore, that the oil burner apparatus of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A petroleum burner apparatus comprising:

housing means for connecting to a petroleum source and an air source, said housing means defining an air passage therein in communication with said air source and a plurality of nozzle ports therein in communication with said petroleum source;

a petroleum discharge nozzle disposed in each of said nozzle ports; and a water ring assembly generally disposed around said housing means and comprising:

an outer ring; and an inner ring positioned at least partially within said outer ring;

wherein, said inner and outer rings define a water chamber therein and one of said inner and outer rings defines a plurality of notches therein, in communication with said chamber, said notches at least partially forming water discharge nozzles whereby water may be sprayed toward said petroleum stream.

2. The apparatus of claim 1 wherein each of said nozzle ports faces in a different direction.

3. The apparatus of claim 1 further comprising retaining means for retaining said nozzles in said nozzle ports.

4. The apparatus of claim 3 wherein said retaining means defines an air discharge nozzle therein, said air discharge nozzle being in communication with said air passage in said housing means.

5. The apparatus of claim 1 further comprising pivotation means for pivotally mounting said housing means on a portion of a petroleum line from the petroleum source.

6. The apparatus of claim 5 wherein said pivotation means is characterized by a ball bearing swivel connection between said housing means and said portion of said petroleum line.

7. The apparatus of claim 5 further comprising locking means for locking said housing means in any pivoted position with respect to said portion of said petroleum line

8. The apparatus of claim 7 wherein said water ring assembly directs a substantially semicircular water spray toward said petroleum and air stream mixture.

9. A burner apparatus comprising:

housing means for connecting to a petroleum line and defining a nozzle port therein in communication with said petroleum line;

nozzle means disposed in said nozzle port for discharging a petroleum stream from said housing means; and a water ring assembly generally disposed around said housing means and comprising:

an outer ring; and an inner ring positioned at least partially within said outer ring;

wherein, said inner and outer rings define a water chamber therein and one of said inner and outer rings defines a plurality of notches therein, in communication with said chamber, said notches at least partially forming water discharge nozzles whereby water may be sprayed toward said petroleum stream.

10. The apparatus of claim 9 wherein said notches are substantially arcuate.

11. The apparatus of claim 9 wherein said water discharge nozzles which are at least partially bounded by a portion of the other of said inner and outer rings.

12. The apparatus of claim 9 wherein said notches are defined in an upper portion of said outer ring and are adjacent to an outer surface of said inner ring.

13. The apparatus of claim 9 wherein said notches are spaced in a substantially arcuate pattern on said water ring assembly.

14. The apparatus of claim 9 further comprising:

a bracket attached to said water ring assembly;

a pin attached to said housing means and extending through said bracket; and retaining means for retaining said pin adjacent to said bracket.

15. The apparatus of claim 9 further comprising means for pivotally attaching said housing means to said petroleum line.

16. The apparatus of claim 15 further comprising locking means for locking said housing means in any of a plurality of pivoted positions.

* * * * *